US010420403B1

(12) United States Patent
Calder

(10) Patent No.: US 10,420,403 B1
(45) Date of Patent: Sep. 24, 2019

(54) APPARATUS AND METHOD FOR CARRYING ITEMS

(71) Applicant: Curtis M. Calder, New York, NY (US)

(72) Inventor: Curtis M. Calder, New York, NY (US)

( * ) Notice: Subject to any disclaimer, the term of this patent is extended or adjusted under 35 U.S.C. 154(b) by 174 days.

(21) Appl. No.: 15/368,370

(22) Filed: Dec. 2, 2016

Related U.S. Application Data

(60) Provisional application No. 62/263,014, filed on Dec. 4, 2015, provisional application No. 62/263,030, filed on Dec. 4, 2015.

(51) Int. Cl.
*A45C 11/18* (2006.01)
*A45C 1/06* (2006.01)

(52) U.S. Cl.
CPC ..... *A45C 1/06* (2013.01); *A45C 11/182* (2013.01)

(58) Field of Classification Search
CPC ..... A45C 1/06; A45C 11/18; A45C 11/182; A45C 15/00
USPC ..... 150/132, 131, 135, 147, 145; 206/39.5, 206/39, 37; D14/435; D3/247
See application file for complete search history.

(56) References Cited

U.S. PATENT DOCUMENTS 1,670,343 A * 5/1928 Clemens ..... A45C 11/18 206/39
4,690,273 A * 9/1987 Smith ..... A24F 27/12 206/104
4,697,698 A * 10/1987 Holdener ..... A45C 11/182 206/37
4,796,750 A * 1/1989 Inghram ..... A45C 1/06 150/131
4,805,680 A * 2/1989 Ueno ..... A45C 11/182 150/145
D324,305 S * 3/1992 Prey ..... D3/247
D431,719 S * 10/2000 Mucarquer ..... D3/247
(Continued)

FOREIGN PATENT DOCUMENTS

NL 2015415 B1 * 3/2017 ..... A45C 11/182

OTHER PUBLICATIONS

3C Carbon Clip: The fastest and slimmest wallet, by Ögon Designs, Jan. 2015, accessed from https://www.kickstarter.com/projects/590166365/3c-carbon-clip-the-fastest-and-slmmest-wallet/description, 28 pgs.

(Continued)

*Primary Examiner* — Fenn C Mathew
*Assistant Examiner* — Cynthia F Collado
(74) *Attorney, Agent, or Firm* — Travis R. Banta; Techlaw Ventures, PLLC

(57) ABSTRACT

An apparatus for carrying one or more items in the form of a wallet includes one or more compartments. The wallet includes a slot to provide access to an interior of a compartment. The slot is positioned such that the one or more items within the compartment can be contacted along their bottom edge. In this manner the slot extends from the bottom edge of the wallet upwards towards the top of the wallet. In some instances the wallet includes interior dividers that have extended edges that extend past the length of the front and back of the wallet. These dividers with extended edges may also have a notch feature. These and other features of the wallet assist in inserting and removing the one or more items from the wallet.

19 Claims, 8 Drawing Sheets

(56) References Cited

U.S. PATENT DOCUMENTS

| | | | | |
|---|---|---|---|---|
| 6,409,360 | B2 * | 6/2002 | Contant | A45C 11/182 362/154 |
| 2008/0023114 | A1 * | 1/2008 | Bridgefarmer | A45C 1/06 150/147 |
| 2009/0014104 | A1 * | 1/2009 | Duchon | A45C 1/08 150/136 |
| 2017/0065047 | A1 * | 3/2017 | Van Der Laan | A45C 11/182 |

OTHER PUBLICATIONS

Claude Wallet | Rose Anvil—A Slim Handmade Wallet, by Rose Anvil, Oct. 2016, accessed from http://www.kickstarter.com/projects/2014891565/claude-wallet-rose-anvil-a-slim-handmade-wallet, 25 pgs.
Corkaw Wallet, by Corkaw, Jul. 2016, accessed from https://www.kickstarter.com/projects/1598944644/corkaw-the-best-slim-wallet-with-a-few-surprises, 13 pgs.
Elemental Wallet, by ElementalWallet, Sep. 12, 2016, accessed from https://www.kickstarter.com/projects/2092669894/elemental-wallet/description, 7 pgs.
User-Friendly Minimalist Wallet + Modern Day Briefcase, by Breton Company, 2016, accessed from https://www.kickstarter.com/projects/94088589/the-convenient-minimalist-wallet?ref=nav_search, 21 pgs.
SimpL Wallet, by SimpL Wallet, Oct. 2016, accessed from https://www.kickstarter.com/projects/1156503551/simpl-wallet/description, 8 pgs.
Tribe 3.0—"The Sexiest Minimalist Wallet", by Chase Ellestad, Feb. 2014, accessed from https://www.kickstarter.com/projects/1753479860/tribe-30-the-sexiest-minimalist-wallet, 16 pgs.
Venture Wallet | Quality & Functional Minimalist Wallet, by Venture Wallet Co., Jun. 2016, accessed from https://www.kickstarter.com/projects/venturewallet/venture-wallet, 12 pgs.
Vessel Wallet, by Vessel, Jan. 2017, accessed from https://www.kickstarter.com/projects/steeklifedesign/vessel-the-easy-access-wallet-with-a-protective-co, 17 pgs.
Walter Wallet, by Walter BV, and Interall Group Company, 2016, accessed from https://walterwallet.com/product/walter-wallet-new/, 16 pgs.

* cited by examiner

FIG. 9
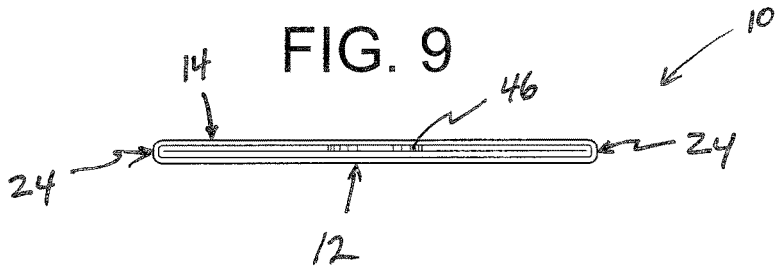
FIG. 10
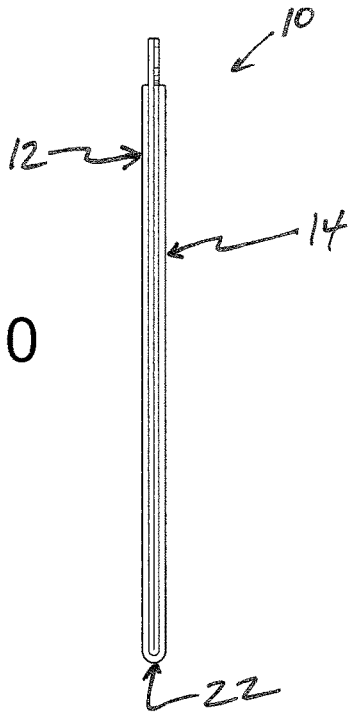
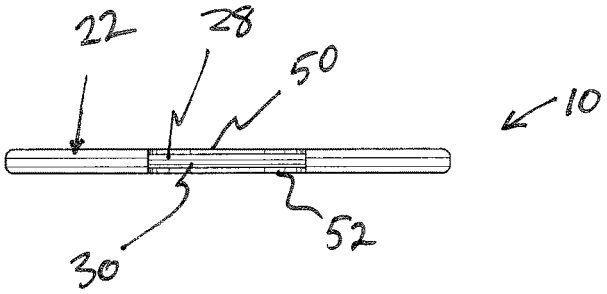
FIG. 11

APPARATUS AND METHOD FOR CARRYING ITEMS

PRIORITY

This application claims priority to U.S. Provisional Patent Application Ser. No. 62/263,014, filed Dec. 4, 2015, entitled "Wallet Extended Edges," the disclosure of which is incorporated by reference herein. This application further claims priority to U.S. Provisional Patent Application Ser. No. 62/263,030, filed Dec. 4, 2015, entitled "Wallet Content Engaging Slots," the disclosure of which is incorporated by reference herein.

BACKGROUND

The apparatuses and methods disclosed pertain to the field of containers, such as a wallet for storing and carrying items. Wallets are often used to carry items in one's pocket throughout day-to-day activities. Typically, wallets include one or more compartments used to separate and organize items, such as credit cards and other cards, within the wallet. Wallets may comprise multiple layers of material such as leather for example. The multiple layers of material of such wallets may have the same height and width and align along the bottom, side, and top of the wallet. The aligning multiple layers of material define respective edges along the bottom, sides, and top of the wallet. Along one of the edges there is generally an opening providing access to one or more of the compartments, by which items may be inserted and removed from the wallet.

Because the layers of material that define the edge having the opening generally align with each other, it can be difficult to access the one or more compartments of the wallet, whether by squeezing the wallet or by pulling apart the layers of material. This can make it difficult to quickly and easily insert or remove items such as credit cards or other cards.

Also, with such wallets, as mentioned there is an opening for each compartment along one edge. The compartments thereof are sealed along the other edges to effectively retain items within the compartments. In this configuration, items such as cards are generally accessed for removal from the wallet from a single location, which is through the opening along the edge having the opening. Because wallets often contain multiple items and all are generally accessible from only a single location, it can be difficult to easily access the desired item when attempting to remove it from the wallet. This can be compounded because the compartments typically have a compact configuration, which may aid in retaining items within the wallet, but may cause the items to bind within the compartments further impeding the easy removal of items.

While a variety of carrying apparatus such as wallets and others have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

FIG. 9 depicts a top view of the wallet of FIG. 1;

FIG. 10 depicts a side view of the wallet of FIG. 1, the opposite side view being a mirror image thereof; and FIG. 11 depicts a bottom view of the wallet of FIG. 1.

Figure 1:
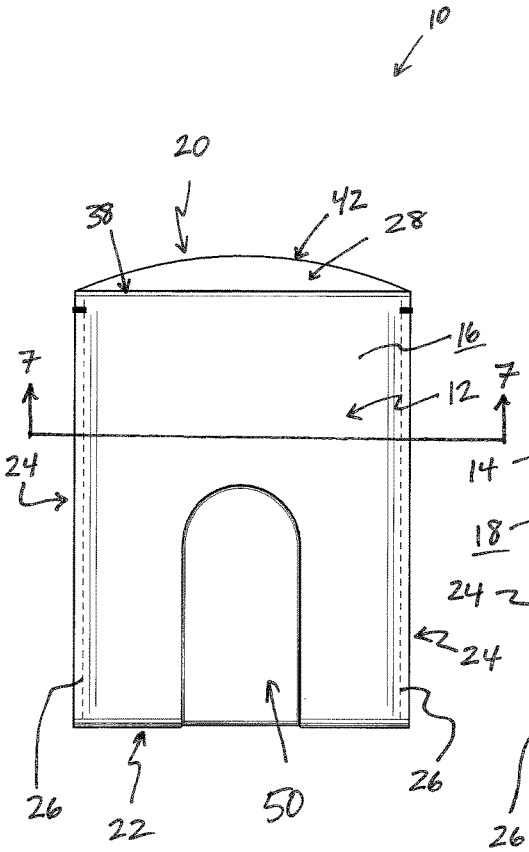
FIG. 1 depicts a front view of an exemplary wallet.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Exemplary Wallet

Figure 2:
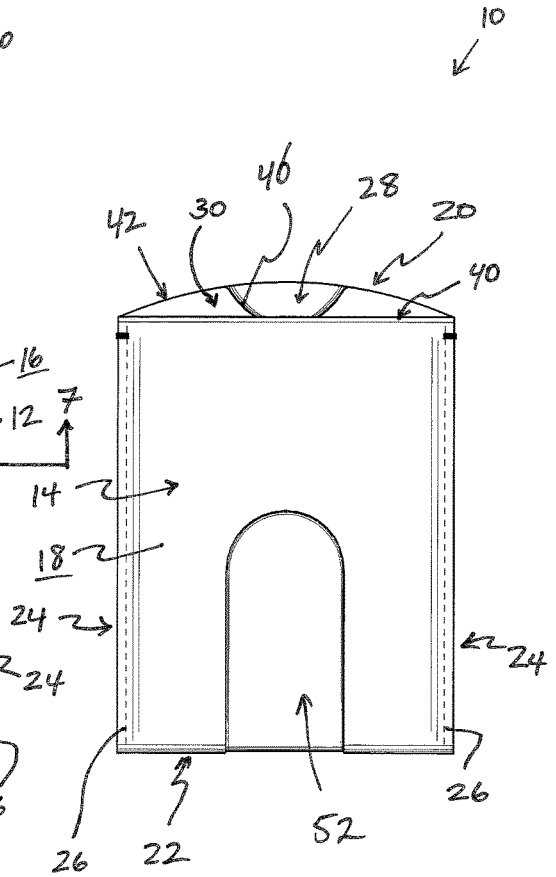
FIG. 2 depicts a rear view of the wallet of FIG. 1.

FIGS. 1-7 and 9-11 illustrate an exemplary apparatus for carrying items, shown in the form of a wallet (10). As shown in FIGS. 1 and 2, wallet (10) comprises a front portion (12) and a rear or back portion (14). Front portion (12) has an outer surface (16), while back portion (14) also has an outer surface (18). Wallet (10) further comprises a top edge (20), a bottom edge (22), and two side edges (24). As shown in the illustrated version, stitching, using thread (26) or a similar material, extends along side edges (24). In the present example, front portion (12) and back portion (14) comprise one continuous piece of material which is folded over on itself, thus eliminating the need for stitching along bottom edge (22). However, in other versions of wallet (10), front portion (12) and back portion (12) are made of separate pieces that are stitched together along both side edges (24) and along bottom edge (22). In terms of materials of construction, wallet (10) can be made of any suitable materials, including but not limited to leather, suede, fabric, plastic, etc.

Wallet (10) further comprises two interior portions (28, 30). Interior portion (28) is located between front portion (12) and back portion (14), adjacent to or nearer to front portion (12). Interior portion (30) is also located between front portion (12) and back portion (14), but adjacent to or nearer to back portion (14).

With this configuration as shown in the illustrated version, front portion (12) and interior portion (28) define a compartment (32) between front portion (12) and interior portion (28). Similarly, back portion (14) and interior portion (30) define a compartment (34) between back portion (14) and interior portion (30). Additionally, interior portion (28) and interior portion (30) define a compartment (36) between interior portion (28) and interior portion (30). With this configuration, compartments (32, 34) are outer compartments of the interior of wallet (10), while compartment (36) is a middle compartment of the interior of wallet (10). Accordingly, interior portions (28, 30) are operably configured as internal dividers that separate front portion (12) from back portion (14). In the same manner, compartment (36) is operably configured as an internal dividing compartment that separates compartment (32) from compartment (34). With interior portions (28, 30) defining compartment (36), interior portions (28, 30) can also be considered internal dividers that separate compartment (32) from compartment (34).

Wallet (10) further comprises openings (38, 40, 42) along top edge (20). Opening (38) is located at the top of and between front portion (12) and interior portion (28), and opening (38) provides access to compartment (32). Opening (40) is located at the top of and between back portion (14) and interior portion (30), and opening (40) provides access to compartment (34). Opening (42) is located at the top of and between interior portion (28) and interior portion (30), and opening (42) provides access to compartment (36). With this configuration, compartments (32, 34, 36) define respective void spaces configured to receive and selectively retain one or more items (44). By way of example only, and not limitation, such items may include credit cards, business cards, identification cards, customer loyalty cards, money, notes, among other things that will be apparent to those of ordinary skill in the art in view of the teachings herein.

Figure 3:
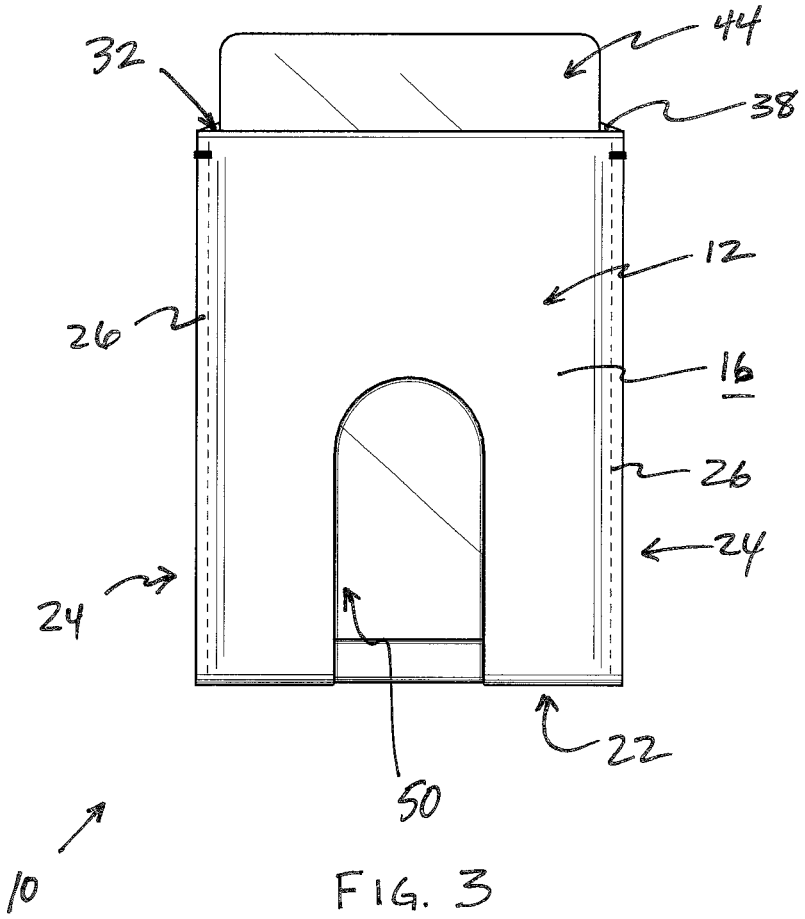
FIG. 3 depicts a front view of the wallet of FIG. 1, with a card partially inserted within an outer compartment.
Figure 6:
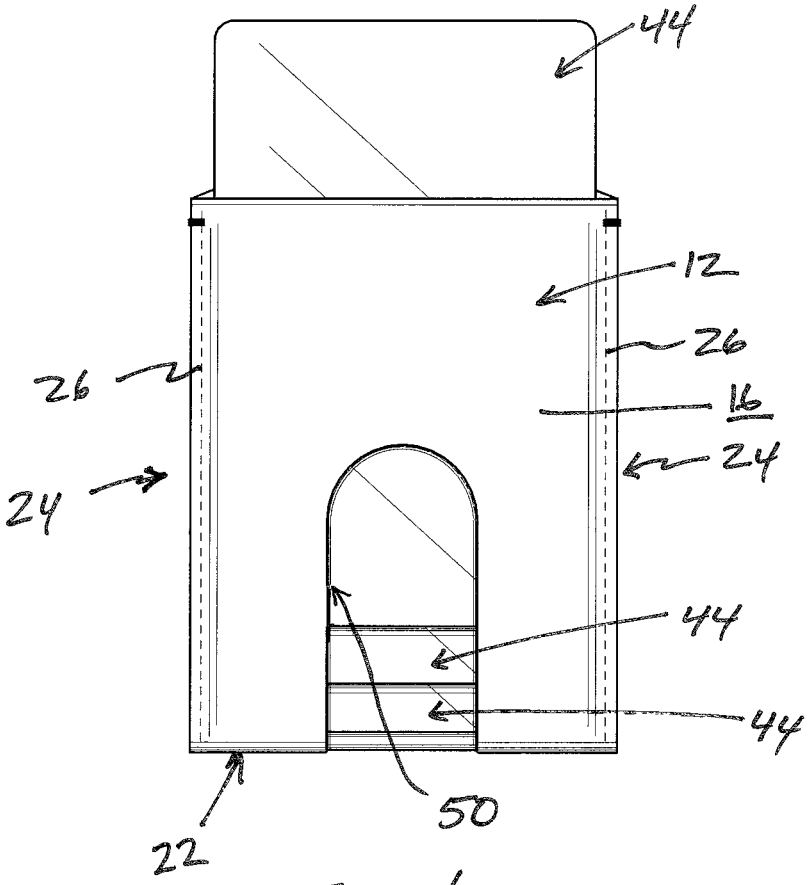
FIG. 6 depicts a front view of the wallet of FIG. 1, with multiple cards inserted within an outer compartment to varying extents.
Figure 7:
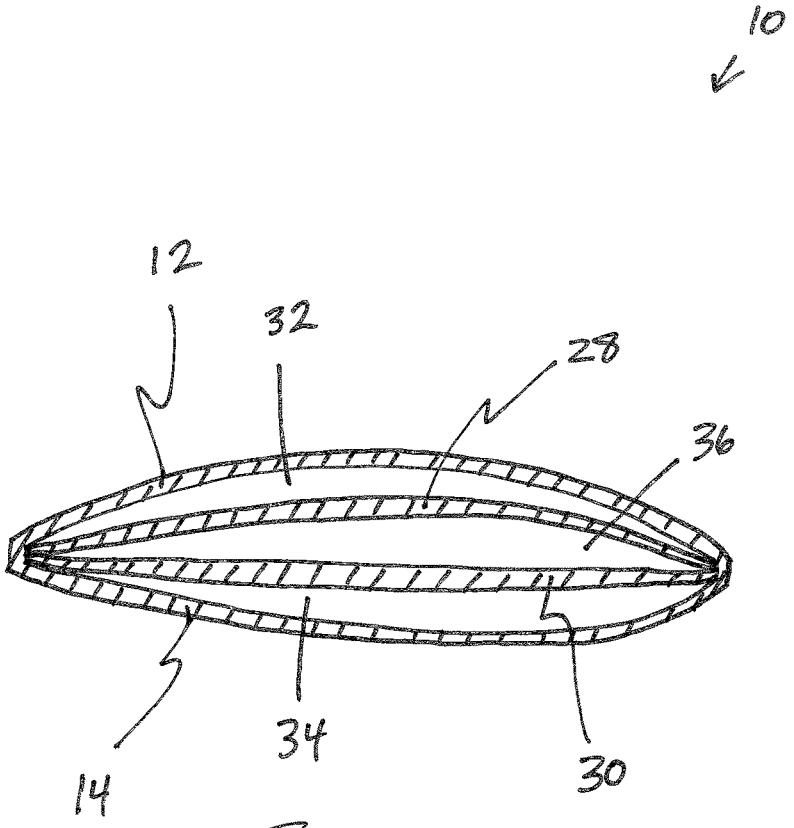
FIG. 7 cross section view of the wallet of FIG. 1 taken along line 7-7, shown with the layers of the wallet slightly separated to better illustrate the compartments within the wallet.

As best seen in FIG. 3, item (44), such as a card, may be inserted into compartment (32) via opening (38) at top edge (20) of wallet (10). In the illustrated example of FIG. 3, compartment (32) is shown holding one item (44) in the form of a card, though compartment (32), and each other compartment (34, 36) as well, may hold multiple items (44) in the form of cards or otherwise. For instance, FIG. 6 illustrates compartment (32) holding a plurality of items (44) in the form of cards. In view of the teachings herein, other ways to configure items (44) within compartments (32, 34, 36) of wallet (10) will be apartment to those of ordinary skill in the art. Additionally, while the present example of wallet (10) shows and describes three compartments, in view of the teachings herein, other ways to configure wallet (10) and its compartments, including the number of compartments, the dimensions of the compartments, and the orientation of the compartments, will be apparent to those of ordinary skill in the art.

A. Extended Edges

Figure 4:
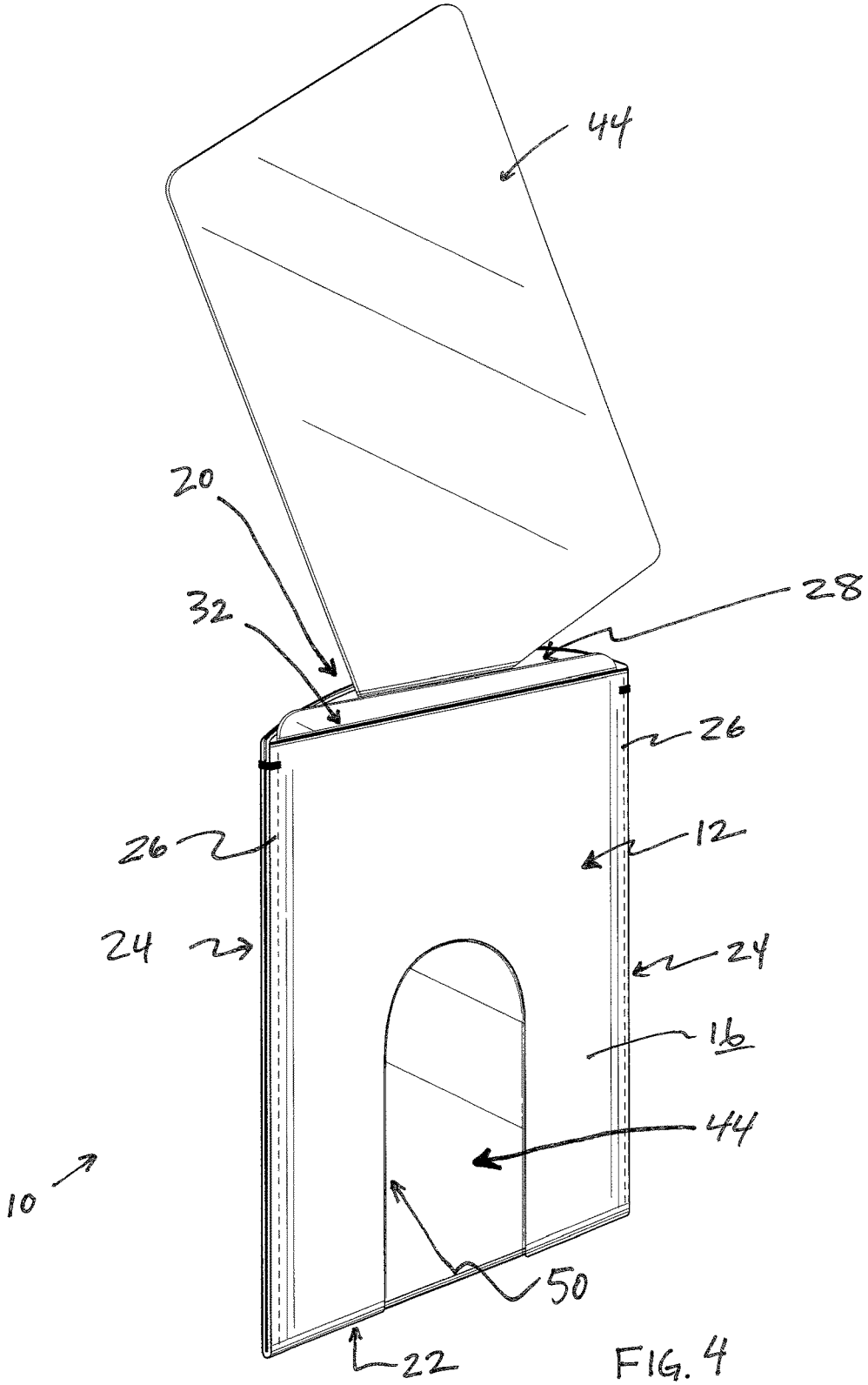
FIG. 4 depicts a front perspective view of the wallet of FIG. 1, with a first card inserted within an outer compartment and a second card partially inserted into the same outer compartment.
Figure 5:
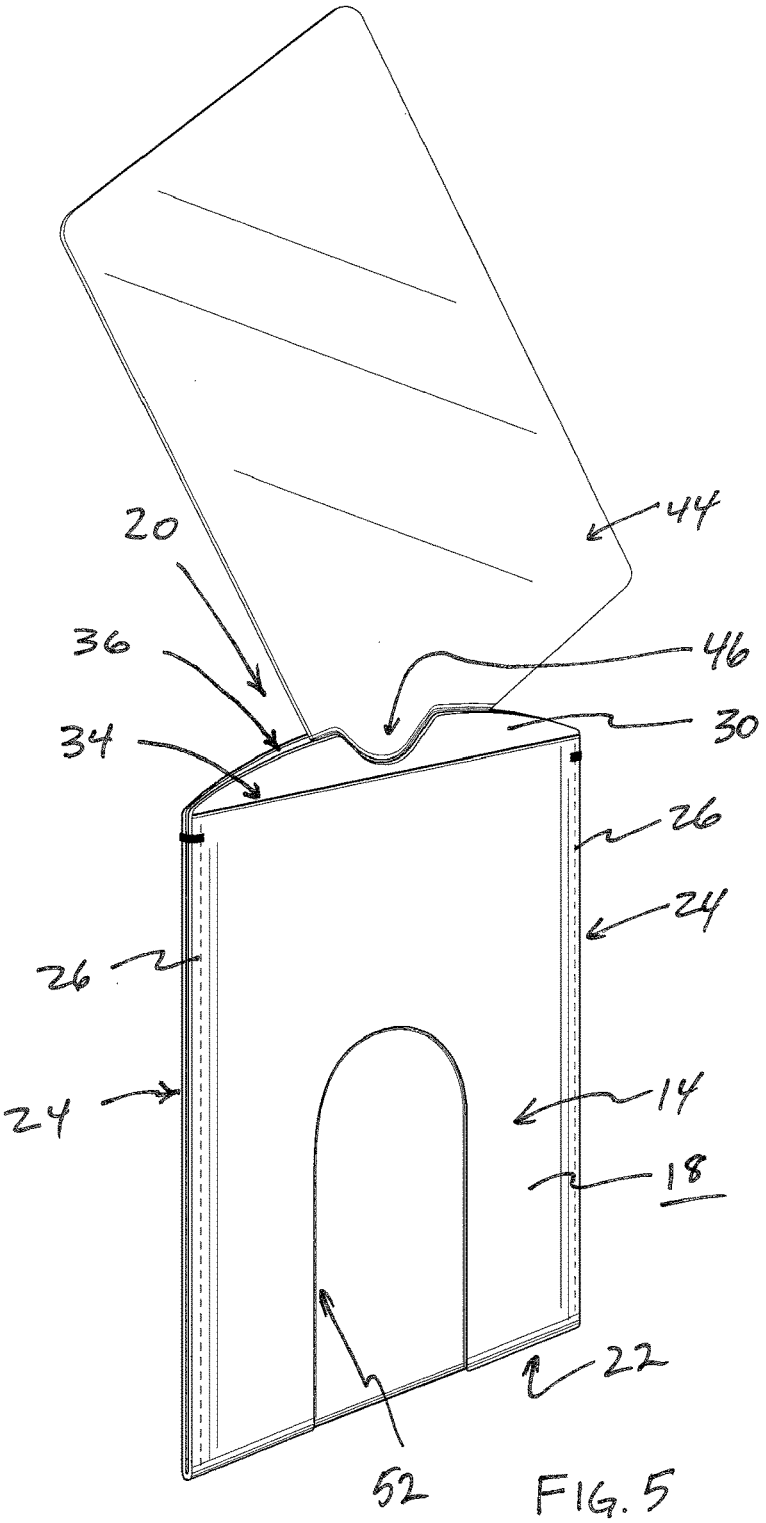
FIG. 5 depicts a front perspective view of the wallet of FIG. 1, with a cart partially inserted within a middle compartment.

Referring to FIGS. 4 and 5, interior portions (28, 30), which together form a middle interior compartment (36), both have a length which exceeds that of front portion (12) and back portion (14). Additionally, interior portion (30) comprises a notch (46), which is a cut-out of material along a center portion in the present example. In this configuration, interior portion (28) has a maximum length that slightly exceeds that of interior portion (30) because of the cut-out that forms notch (46). As will be discussed further below, the differing lengths for interior portions (28, 30) compared to front and back portions (12, 14) provide structure that aids in inserting and removing items (44) from compartments (32, 34) of the wallet (10). As will also be discussed further below, the differing maximum lengths for interior portion (28) compared to interior portion (30) provide structure that aids in inserting and removing items (44) from compartment (36) of the wallet (10).

Still referring to FIGS. 4 and 5, and as mentioned above, interior portion (28) and interior portion (30) each comprise a length that exceeds that of front portion (12) and back portion (14). As shown in FIG. 4, one item (44) in the form of a card can be seen already inside outer compartment (32) as deeply as it can be inserted. A second item (44) in the form of a card can be seen entering outer compartment (32) behind first item (44) but in front of interior portion (28). Interior portion (28) here is operably configured as a platform or structure that guides the insertion of second item (44). For instance, a user places second item (44) against a front surface of interior portion (28), and by pressing against it, opens outer compartment (32) enough to insert second item (44) into outer compartment (32) next to first item (44).

As shown, first item (44) when fully inserted within compartment (32) extends past the top of front portion (12). Thus alternatively, a user may place second item (44) against a front surface of first item (44), and by pressing against it, open outer compartment (32) enough to insert second item (44) into outer compartment (32) next to first item (44). In this alternative insertion process, second item (44) would be inserted in front of first item (44). This alternative insertion process may be particularly useful when one or more items (44) inserted within wallet (10) have a length that is longer than the length of interior portion (28) such that interior portion (28) is obscured or obstructed by one or more items (44) already within compartment (32).

The illustration and description of inserting one or more items (44) within compartment (32), applies equally with inserting one or more items (44) within compartment (34) located between back portion (14) and interior portion (30). In particular, one item (44) in the form of a card can be inside outer compartment (34) as deeply as it can be inserted. Second item (44) in the form of a card can enter outer compartment (34) behind first item (44) but in front of interior portion (30). Interior portion (30) here is operably configured as a platform or structure that guides the insertion of second item (44). For instance, a user places second item (44) against a front surface of interior portion (30), and by pressing against it, opens outer compartment (34) enough to insert second item (44) into outer compartment (34) next to first item (44).

When first item (44) is fully inserted within compartment (34), it extends past the top of back portion (14). Thus alternatively, a user may place second item (44) against a front surface of first item (44), and by pressing against it, open outer compartment (34) enough to insert second item (44) into outer compartment (34) next to first item (44). In this alternative insertion process, second item (44) would be inserted in front of first item (44). This alternative insertion process may be particularly useful when one or more items (44) inserted within wallet (10) have a length that is longer than the length of interior portion (30) such that interior portion (30) is obscured or obstructed by one or more items (44) already within compartment (34).

Referring to FIG. 5, item (44) in the form of a card is being inserted into middle compartment (36), which is formed by interior portions (28, 30) as described above. As described above and as shown in FIGS. 2 and 5, interior portion (28) has a curved edge at the top, while interior portion (30) has a curved edge at the top but with notch (46), which in the present example is formed by a cut-out of material in interior portion (30). To easily insert item (44) into middle compartment (36), from the back side of wallet (10) with back portion (14) facing a user, the user may use a portion of item (44), for instance the corner of a card as in the present example, to press against an uppermost portion of interior portion (28) accessible through the cut-out defined by notch (46) in interior portion (30). In pressing against the uppermost portion of interior portion (28), middle compartment (36) is opened slightly to allow insertion of item (44).

Thus, in this configuration, one of interior portions (28) is used as a platform or structure against which item (44) can contact to open compartment (36) for inserting item (44) within compartment (36). Without notch (46) in interior portion (30), the user would need to attempt to separate interior portions (28, 30) using his or her fingers, or he/she would need to push sides edges (24) toward each other in an attempt to open middle compartment (36). The configuration with elongated interior portions (28, 30), with one having notch (46), provides for another way to access middle compartment (36) that can provide for easier insertion of items (44).

In a similar fashion, notch (46) also provides for a structure to assist in accessing one or more items (44) within compartment (36) for removal from wallet (10). For instance, a user may use a finger or other object to push against the uppermost portion of interior portion (28) through the cut-out defined by notch (46) in interior portion (30). This in turn opens middle compartment (36) at least slightly to provide access to retained items (44) for removal from wallet (10).

While the above examples have described interior portions (28, 30) as having a longer length compared to front and back portions (12, 14), the term "length" is used as a reference. In other instances, one may define this longer dimension of interior portions (28, 30) as a width or a height. Thus the use of the term "length" should not be interpreted in a limiting manner. In some other instances, the longer length of interior portions (28, 30) are described as extended edges. In such instances, wallet (10) comprises interior portions (28, 30) having extended edges that extend past the top edges of front and back portions (12, 14). With such an example, top edge (20) refers to any of the top edges of front portion (12), back portion (14), and/or interior portions (28, 30). Other terms and ways to describe the size, proportions, and relative position of components of wallet (10) will be apparent to those of ordinary skill in the art in view of the teachings herein.

B. Access Slots

Still referring to FIGS. 1-7, wallet (10) further comprises slots (50, 52) formed in front portion (12) and back portion (14) respectively. Slots (50, 52) extend upwards from bottom edge (22) toward top edge (20) to approximately a middle region of wallet (20). While the present example illustrates and describes slots (50, 52) in both front portion (12) and back portion (14), in some other versions of wallet (10) only one of slots (50, 52) is present. Slots (50, 52) are operably configured to allow items (44) within wallet (10) to be accessed by direct contact by a user from the exterior of wallet (10).

As described above and as shown in FIGS. 3-6, one or more items (44), for example in the form of cards, may be inserted into any or all compartments (32, 34, 36) of wallet (10) via openings (38, 40, 42) along top edge (20). Each of compartments (32, 34, 36) may hold one item (44), or multiple items (44). By way of example only, FIG. 6 illustrates an instance where compartment (32) contains multiple items (44) in the form of three cards. In view of the teachings herein, other ways to configure items (44) within compartments (32, 34, 36), or other ways to configure compartments (32, 34, 36) themselves, will be apartment to those of ordinary skill in the art.

Slots (50, 52) provide a way to aid in both selecting and removing one or more items (44) from the interior of wallet (10). More specifically, slot (50) provides a way to aid in selecting and removing one or more items (44) from compartment (32) of wallet (10). Slot (52) provides a way to aid in selecting and removing one or more items (44) from compartment (34) of wallet (10). As mentioned above, slots (50, 52) are formed in front portion (12) and back portion (14) respectively. Furthermore, slots (50, 52) comprises cut-out areas in the material of front portion (12) and back portion (14) respectively. This configuration allows for slot (50) to provide access to items (44) contained within compartment (32) of wallet (10). Similarly, this configuration allows for slot (52) to provide access to items (44) contained within compartment (34) of wallet (10). As seen in the illustrated version, items (44) within compartments (32, 34) are accessible both visibly and physically through slots (50, 52). Thus, a user can both see items (44) through slots (50, 52) and contact or touch items (44) through slots (50, 52).

With the configuration of slots (50, 52) described above, slots (50, 52) allow items (44) within compartments (32, 34) to be engaged by a user from along bottom edge (22) of wallet (10). In this manner of engaging items (44) within compartments (32, 34) through slots (50, 52), one may push one or more items (44) upwards from bottom edge (22), thus beginning the process of removal. Once the user pushes items (44), such as cards, upwards via slots (50, 52), items (44), such as cards, can be easily gripped and pulled the rest of the way out from compartments (32, 34) of wallet (10). This is helpful to the user of wallet (10), as in wallets without such slots (50, 52) it can be difficult to remove items (44) from interior compartments as such items (44) are not accessible from along bottom edge (22). And furthermore, wallets generally are constructed with very little extra room, so as to promote the function of retaining items (44) securely within the wallet.

In the present example, slots (50, 52) begin at bottom edge (22) of respective front portion (12) and back portion (14). With this configuration, a user is able to interact and engage with the bottom of items (44) retained within compartments (32, 34). Engaging with the bottom of items (44) enable the user to direct a force on items (44) in the direction of openings (38, 40) along top edge (20). In other words, the user can engage with the bottom of items (44) along bottom edge (22) of wallet (10) to apply a force to items (44) in a direction parallel with a plane defined by wallet (10). Moreover, this force can be applied to items (44) in a way where substantially all the force applied is in this direction parallel with the plane defined by wallet (10).

For instance, in an exemplary wallet without slots (50, 52), where other openings are located in a middle region of a front and a back of the wallet, where such openings did not extend to a bottom edge of the wallet, moving items (44) from within compartments of the wallet, without pulling them from openings along a top edge of the wallet, would be more difficult. This is because, a substantial amount of the force applied to move items (44) would be in a direction perpendicular to the plane defined by the wallet to create enough friction between the surface of a user's finger and a surface of items (44) to eliminate slippage between a user's finger and items (44) when trying to slide items (44) toward the openings along the top edge of the wallet. Thus, to generate sufficient force in a direction parallel to the plane defined by the wallet to advance items (44) toward the openings along the top edge, in this example where middle openings replace slots (50, 52), a much greater amount of overall force is needed.

FIG. 6 illustrates three items (44), in the form of three cards, contained within compartment (32). In this example, slot (50) aids in selecting which card will be removed when it is desired to remove one or multiple cards, but to leave others within compartment (32). As shown in FIG. 6, in response to a force applied to the cards from a user pushing the cards upwards directly from each card's bottom edge, it is possible to push different cards within the same compartment (32) upwards to varying extents or distances, thus staggering the extent to which each card protrudes from opening (38) along top edge (20). This is very helpful to the user, as certain cards may be used more often and for different purposes than others, and one may wish to position those cards closer to the front portion (12) of wallet (10) to make those cards more accessible via slot (50). In this manner, slot (50) also provides the ability to fan out one or more items (44) contained within compartment (32). For instance, pushing cards by way of slot (50) toward opening (38) along top edge (20) at varying extents creates an effect similar to the individual blades of a fan, increasing visibility of each card and thus making it easier to select the right one.

In addition to their ability to provide access to items (44) within wallet (10) from bottom edge (22), slots (50, 52) also provide a reduced contact area with items (44) contained within compartments (32, 34) of wallet (10). This reduced contact area can reduce the binding effect that can occur when multiple items (44) are contained within wallet (10). In other words, slots (50, 52) reduce the amount of material of front portion (12) and back portion (14) that would otherwise contact items (44) within compartments (32, 34).

In the present example, slots (50, 52) are connected along bottom edge (22) of wallet (10). As described above, front portion (12) and back portion (14) are formed of a single piece of material that is folded over on itself and stitched along side edges (24). Slots (50, 52), in the present example, are created by an elongated circular cut-out being made in the material prior to folding the material over on itself to define front portion (12) and back portion (14). As shown in FIG. 11, with slots (50, 52) connected along bottom edge (22), a portion of interior portions (28, 30) are visible or exposed from the bottom of wallet (10) through slots (50, 52). This is in addition to portions of interior portions (28, 30) being visible or exposed along front portion (12) and back portion (14) of wallet (10) through slots (50, 52). Also, in the present example, interior portions (28, 30) are formed from a single piece of material folded over on itself; however, in other versions interior portions (28, 30) are constructed from separate pieces of material that are fastened or connected together, e.g. by stitching along their bottom edge. In other examples of wallet (10), slots (50, 52) are not required to be connected or formed from a single cut-out of material.

Additionally, with slots (50, 52), an empty wallet (10) comprises a passage on each of the front and back of wallet (10) with the passages extending through wallet (10) from the top to the bottom. When wallet (10) is empty, or at least when compartments (32, 34) are empty, these passages are see-through such that when looking upon wallet (10) from along top edge (20), one can see out bottom edge (22) of wallet (10). Stated another way, these passages represent a portion of compartments (32, 34) such that compartments (32, 34) can be considered see-through in the same manner when empty. Stated yet another way, compartments (32, 34) comprise an unsealed top edge and unsealed bottom edge.

II. Exemplary Wallet with Angled Slit

Figure 8:
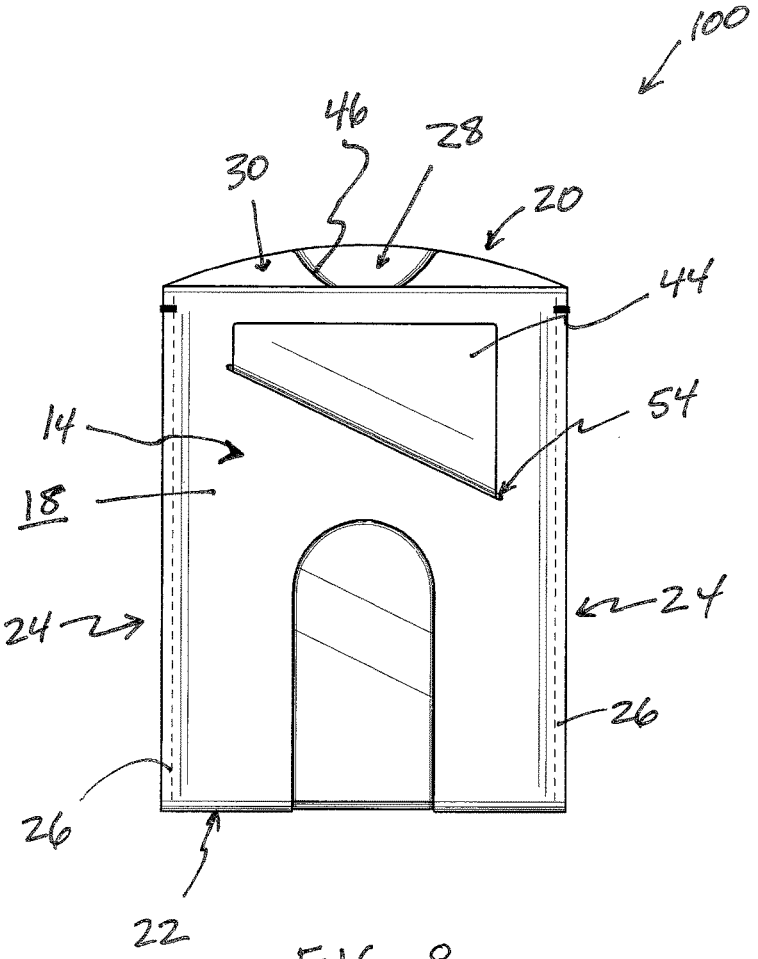
FIG. 8 depicts a rear view of another exemplary wallet similar to that of FIG. 1, but shown with an optional slit and an item of cash inserted through the slit.

FIG. 8 illustrates another exemplary wallet (100) that incorporates an angled slit (54) in back portion (14). Wallet (100) is the same in all respect to wallet (10) shown and described above, except with the addition of slit (54). Therefore, the description above with respect to wallet (10) shall be understood to apply equally to wallet (100), and such description is not repeated here for the sake of conciseness.

While in the illustrated version of FIG. 8, slit (54) is formed in back portion (14), in other versions slit (54) may be formed instead or in addition in front portion (12). Also, while slit (54) is illustrated as angled or in a diagonal fashion, in other versions the angle may be greater or less, or slit (54) may be straight across the width of wallet (100).

Slit (54) provides access to compartment (34) of wallet (100). In one exemplary use, slit (54) provides a location for holding cash, receipts, or notes such that they may be kept at least partially separate from other items (44) such as cards. In the present example slit (54) is formed only in the material of back portion (14), and thus does not provide access to middle compartment (36). However, in some other versions slit (54) may extend through the material of back portion (14) and through the material of interior portion (30) to provide access to middle compartment (36). In view of the teachings herein, other ways to modify and use slit (54) will be apparent to those of ordinary skill in the art in view of the teachings herein.

The above exemplary wallets (10, 100), provide structures and methods of use that provide users with the ability to quickly insert or remove one more items (44), such as credit cards or other cards, from compartments (32, 34, 36) within wallets (10, 100) with minimal effort. Additionally, wallets (10, 100) provide structures and methods of use that provide users with the ability to directly engage one or more items (44) contained within wallet (10, 100), such as credit cards or other cards, from along bottom edge (22). Various modifications to the structures and methods of use shown and described herein, some of which have been described, will be apparent to those of ordinary skill in the art in view of the teaching herein.

III. Miscellaneous

The term "wallet" as used herein should be understood to include any of several types and configurations of apparatus for carrying or storing items, and should not be limited to only the precise configurations in the illustrated examples. Wallets may include, for example, card holders, bi-fold wallets, tri-fold wallets, travel wallets, among others.

The term "item" as used herein should be understood to include any of several types of articles that one may desire to carry or store in a wallet, and should not be limited to only the precise types of articles in the illustrated examples. Items may include, for example, credit cards, identification cards, driver's licenses, office building badges, company or customer loyalty cards, business cards, money, notes, among others. Also, in some cases one or more items may be individually or collectively referred to as "content" or "contents."

The term "compartments" as used herein may also be used interchangeably with similar terms that describe spaces for carrying or storing items. By way of example, the terms "compartment" and "compartments" may be used interchangeably with the terms "pocket" and "pockets" respectively.

The term "slots" as used herein may also be used interchangeably with similar terms that describe openings for accessing carried or stored items. By way of example, the terms "slot" and "slots" may be used interchangeably with the terms "opening" and "openings" respectively. Additionally a slot could be called "cut-out" in some instances.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. An apparatus for carrying one or more items, the apparatus comprising:

a front portion;

a back portion, wherein the back portion is located opposite to the front portion;

a top edge, wherein the front portion and the back portion are open along the top edge;

a bottom edge, wherein the front portion and the back portion are at least partially sealed together along the bottom edge;

a pair of side edges, wherein the front portion and the back portion are sealed together along the pair of side edges;

a first compartment located within the apparatus between the front portion and a divider disposed between the front portion and the back portion, the divider being fixedly connected to each of the pair of side edges and extending continuously between the side edges, wherein the first compartment receives and selectively retains the one or more items within the first compartment; and a first slot formed in the front portion, wherein the first slot extends from the bottom edge towards the top edge, wherein the divider extends from the bottom edge to at least a top of the first slot such that an opening in the first slot is entirely encompassed from behind the opening by the divider and wherein the opening in the first slot provides access to only the first compartment from the bottom edge of the apparatus.

2. The apparatus of claim 1, wherein the divider located between the front portion and the back portion defines a second compartment between the divider and the back portion.

3. The apparatus of claim 1, wherein a length of the divider is a longer length than each of the front portion and the back portion.

4. The apparatus of claim 3, wherein the longer length of the divider relative to the front portion and the back portion first contacts the one or more items when inserting the one or more items into the first compartment.

5. The apparatus of claim 1, further comprising:

a second divider, wherein the second divider is located between the front portion and the back portion and adjacent to the first divider;

a second compartment, wherein the second compartment is defined by the second divider and the back portion; and a third compartment, wherein the third compartment is defined by the first divider and the second divider.

6. The apparatus of claim 5, wherein a length of at least one of the first divider and the second divider is a longer length than each of the front portion and the back portion.

7. The apparatus of claim 6, wherein the length of the first divider is longer than the front portion and the back portion, wherein the longer length of the first divider relative to the front portion and the back portion first contacts the one or more items when inserting the one or more items into the first compartment.

8. The apparatus of claim 6, wherein the length of the second divider is longer than the front portion and the back portion, wherein the longer length of the second divider relative to the front portion and the back portion first contacts the one or more items when inserting the one or more items into the second compartment.

9. The apparatus of claim 6, wherein the lengths of both the first divider and the second divider extend past a length of each of the front portion and the back portion.

10. The apparatus of claim 9, wherein a select one of the first divider and the second divider comprise a notch.

11. The apparatus of claim 10, wherein the notch is located along a top edge of the select one of the first divider and the second divider.

12. The apparatus of claim 11, wherein the notch provides access to the select one of the first divider and the second divider not having the notch, such that an uppermost portion of the select one of the first divider and the second divider not having the notch first contacts the one or more items when inserting the one or more items into the third compartment.

13. The apparatus of claim 9, wherein the first divider and the second divider each comprise a curved top edge.

14. The apparatus of claim 1, further comprising:

a second slot formed in the back portion, wherein the second slot extends from the bottom edge towards the top edge, wherein the second divider extends from the bottom edge to at least a top of the second slot such that an opening in the second slot is entirely encompassed from behind by the second divider and wherein the opening in the first slot provides access to only the second compartment, from the bottom edge of the apparatus.

15. The apparatus of claim 14, wherein the first divider and the second divider are adjacent and form a third compartment between the first divider and the second divider.

16. The apparatus of claim 14, wherein the front portion and the back portion are formed from a single piece of material folded over on itself, and wherein the first slot and the second slot are formed from a single cut-out in the single piece of material forming the front portion and the back portion, wherein the single cut-out is folded over on itself.

17. An apparatus for carrying one or more items, the apparatus comprising:

a first compartment configured to receive and selectively retain the one or more items, wherein the first compartment is defined by a front portion and a first divider;

a second compartment configured to receive and selectively retain the one or more items, wherein the second compartment is defined by a back portion and a second divider;

a third compartment configured to receive and selectively retain the one or more items, wherein the third compartment is defined between the first divider and the divider;

a pair of extended edges formed with and extending from the respective first interior portion and the second interior portion, wherein the pair of extended edges extend a length of the first interior portion and the second interior portion, wherein the first divider and the second divider are fixedly connected to each of the pair of extended edges, wherein the pair of extended edges extend a length of the first divider and the second divider relative to the front portion and the back portion such that the first divider and the second divider are longer than the front portion and the back portion;

a first slot formed in the front portion, wherein the first slot extends from a bottom edge of the apparatus towards a top edge of the apparatus wherein the first divider extends from the bottom edge to at least a top of the first slot such that an opening in the first slot is entirely encompassed from behind the opening by the first divider and wherein the opening in the first slot provides access to only the first compartment from the bottom edge of the apparatus; and a second slot formed in the back portion, wherein the second slot extends from a bottom edge of the apparatus towards a top edge of the apparatus, wherein the second divider extends from the bottom edge to at least a top of the second slot such that an opening in the second slot is entirely encompassed from behind the opening by the second divider and wherein the opening in the second slot provides access to only the second compartment from the bottom edge of the apparatus.

18. The apparatus of claim 17, further comprising a notch formed in a select one of the first divider and the second divider along the top edge.

19. The apparatus of claim 17, wherein openings along the top edge and along a bottom edge, wherein the opening in the first slot opens along the bottom edge.

* * * * *